US005196650A

United States Patent [19]

Cytron

[11] Patent Number: 5,196,650

[45] Date of Patent: Mar. 23, 1993

[54] PROJECTILE AND SABOT ASSEMBLY

[75] Inventor: Sheldon Cytron, Mountain Lakes, N.J.

[73] Assignee: The United States of America as represented by the Secretary of the Army, Washington, D.C.

[21] Appl. No.: 893,481

[22] Filed: Jun. 3, 1992

[51] Int. Cl.[5] ..... F42B 14/06

[52] U.S. Cl. ..... 102/521

[58] Field of Search ..... 102/520–523

[56] References Cited

U.S. PATENT DOCUMENTS 4,382,411 5/1983 Ambrosini ..... 102/523
4,424,748 1/1984 Schiff ..... 102/520
4,759,293 7/1988 Davis, Jr. ..... 102/520
4,911,080 3/1990 Leeker et al. ..... 102/520

FOREIGN PATENT DOCUMENTS 3704027 8/1988 Fed. Rep. of Germany ..... 102/521

*Primary Examiner*—Harold J. Tudor
*Attorney, Agent, or Firm*—Anthony T. Lane; Edward Goldberg; Michael C. Sachs

[57] ABSTRACT

A projectile-sabot assembly includes a projectile rod enclosed by a plurality of sabot pieces and a plurality of heat sensitive shape memory alloy metal shims positioned so that when the assembly is fired, the shims heat up and expand to exert separating forces on the sabot pieces.

4 Claims, 2 Drawing Sheets

PROJECTILE AND SABOT ASSEMBLY

The invention described herein may be manufactured, used and licensed by or for the Government of the United States for governmental purposes without the payment of any royalties thereon.

BACKGROUND OF THE INVENTION

Long rod kinetic energy penetrators are used in ordnance in various calibers from 25 mm to 120 mm. In all cases, these penetrators require a sabot assembly to impart kinetic energy and momentum to the sub-caliber kinetic energy rod while being launched from the gun. The sabot assembly must effectively disengage from the rod once it has left the gun so as not to excessively degrade the kinetic energy of the penetrator in its flight to the target. It must also be constructed of high strength light weight material so as to minimize its parasitic weight.

At the present time, a typical sabot assembly is composed of matched sections, usually three or more, that engages the grooves on the penetrator rod. During launch, while the assembly and rod are traveling in the gun barrel, the propellant gas pressure and the rotating band engraving operation for rifled gun barrels maintain the sabot assembly on the rod so that the accelerating forces on the sabot can be transmitted effectively to the rod and accelerate both the sabot and the rod together down the gun barrel. Once the sabot and rod are out of the barrel, aerodynamic forces are used to lift the sabot sections free of the traveling rod. This disengagement is critical, since it must be done so as not to give any extraneous moment of force to the rod which would cause the rod to deviate off target. The sabot is designed to provide an air scoop in the front of the sabot and this air scoop must provide sufficient disengagement force. As is often the situation, effective disengagement is difficult to achieve reliably without somewhat affecting the flight accuracy.

The kinematics of sabot removal is complex and involves conservation of momentum and force and moment interactions between the sabot sections and the penetrator rod to which they are attached. Kinematically, a clean sabot discard requires the forces on the penetrator rod to be balanced at the instant of separation so as not to impart an overturning moment to the penetrator projectile.

SUMMARY OF THE INVENTION

The present invention provides an asssembly of temperature sensitive shape memory alloy metal pieces inserted into the sabot sections when these sabot sections are coupled to the projectile. Since these metal pieces are temperature sensitive, when the weapon is fired, the metal pieces heat up and undergo a phase transformation to provide the strong auxiliary forces which cause the sabot sections to separate from the projectile independently of aerodynamic forces. The invention enhances flight accuracy and improves ballistic performance and permits lighter sabots to be used than what were required in the past when aerodynamic forces alone forced the sabot separation from a projectile.

DESCRIPTION OF THE INVENTION

Figure 1:
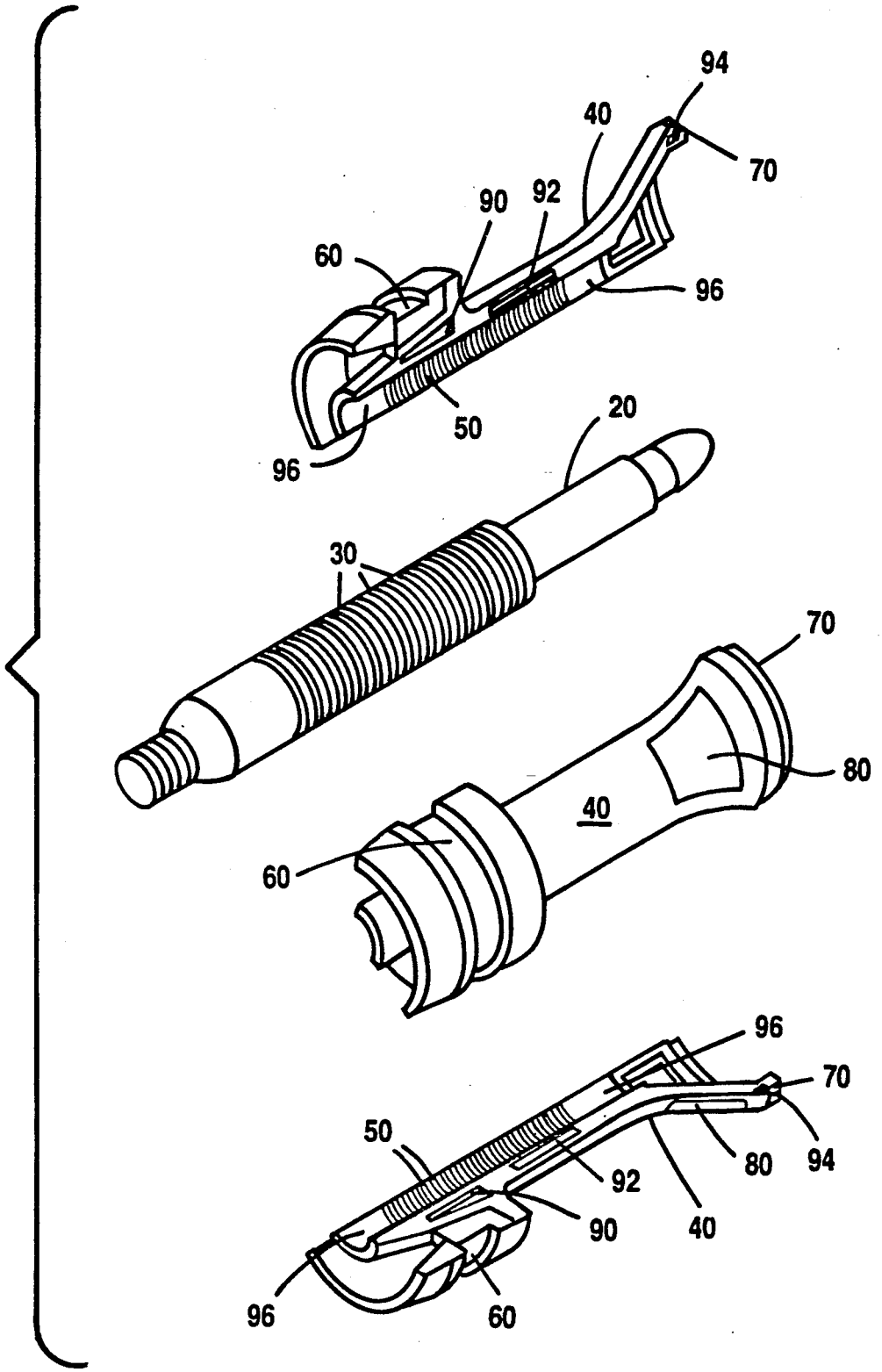
FIG. 1 is a perspective, exploded view of a projectile penetrator rod embodying the invention.

FIG. 1 shows a projectile assembly including a penetrator rod 20 and an associated sabot assembly. The projectile rod is generally tubular in form and includes grooves 30 along a suitable portion of its surface. The sabot assembly includes at least three separate sections (or petals) 40 which are portions of a cylinder and each includes, on its inner surface, grooves 50 which mate with and engage the grooves 30 on the projectile rod when the sabot petals are coupled to the projectile rod 20.

Each sabot section or petal has a groove 60 in its outer wall near its rear end and these grooves 60 are aligned so that they form a continuous groove when the three petals are coupled to the projectile rod. A securing band (not shown) is seated in the aligned grooves 60 when all parts are assembled. The front end of each sabot petal also curves upwardly away from the projectile rod and the leading end of each petal is provided with a step formation 70 which also receives a securing ring (not shown) when the parts are assembled. The diameter of the rear end of each petal and the degree of outward flare of the front end of each petal are dimensioned so that these portions properly engage the gun barrel when the projectile is fired and proceeds along the gun barrel.

Each petal has a cutout portion 80 at its front end to reduce the mass of the petal. This cutout portion is of any suitable size and shape permitted by the shape and size of the petal.

The body of each petal 40 is provided with a plurality of slotted cavities, for example three cavities 90, 92 and 94, which are aligned with each other when the petals are assembled, with adjacent petals abutting each other as they surround a projectile rod. The slots 90 are located near the rear of the petals, the slots 92 are located at about the center of the petals and the slots 94 are located near the front end of the petals. Each petal also has curved depressions 96 on its inner surface near the rear and front ends thereof. These curved depressions 96 are also aligned with each other when the petal parts and projectile are assembled.

According to the invention, a plurality of temperature sensitive shape memory alloy metal shims are provided between abutting petals and between the petals and the projectile 20 to facilitate separation of the petals from each other and from the projectile when the projectile is fired.

The temperature sensitive shims are placed between each sabot petal and between the petals and the projectile. The shims are shape memory alloys and thus have the unique ability to change shape, that is undergo a phase transformation when heated, and conform to a new predetermined shape. Thus when conforming to this new shape, the shims can exert strong forces over small displacements and can readily and easily detach the sabots from each other and the from the projectile as it leaves the gun barrel. The shims may be made of a nickel-titanium alloy or the like in which the composition is selected so that the thermal actuation temperature can be set at a reasonable temperature, sufficiently far above any storage temperatures yet sufficient to be reached by thermal inputs during launching in the gun barrel.

Figure 2:
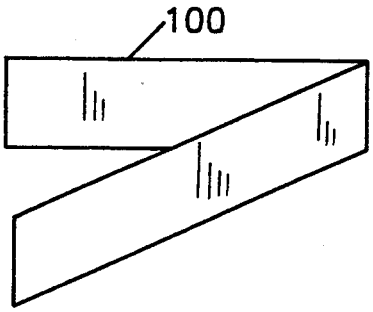
FIG. 2 is a perspective view of one embodiment of a portion of the invention.
Figure 3:
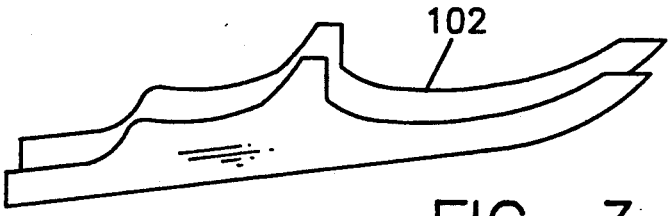
FIG. 3 is a perspective view of another embodiment of a portion of the invention.
Figure 4:
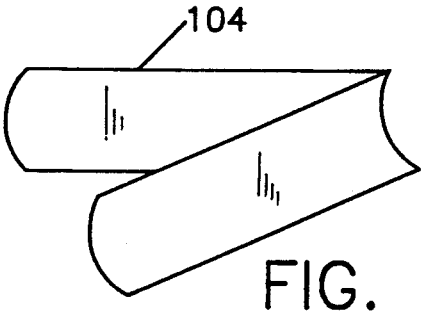
FIG. 4 is a perspective view of still another embodiment of a portion of the invention.

In practicing the invention, three shims of the type shown in FIGS. 2,3, and 4 are used. The shim 100 shown in FIG. 2 is V-shaped and is made by pre-bending an alloy strip. The shim 102 of FIG. 3 is in the form of a gasket and appearing somewhat like an elongated V shape. The shim of FIG. 4 is like the shim of FIG. 2 except that its two plates are curved to match the curvature of the portions 96 of the petal.

Figure 5:
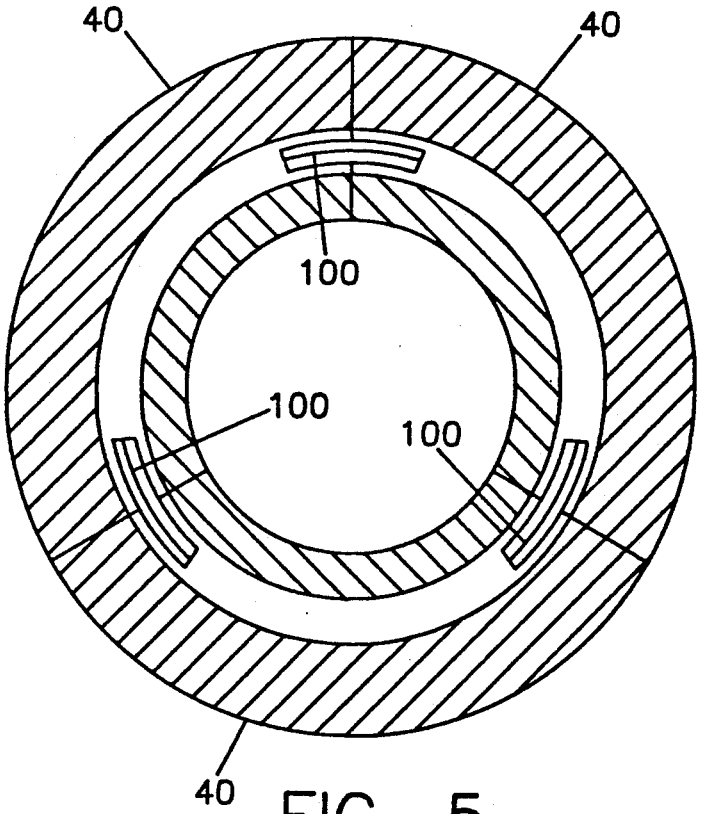
FIG. 5 is a sectional view of the invention.

In using the shims, a shim 100 is inserted in the cavities 90 of two adjacent petals and in the adjacent cavities 92 and 94 of adjacent petals. Shims 100 are illustrated in the assembly shown in FIG. 5. In addition, tubular shims 104 are disposed in the annular depressions 96 in the assembly of petals. These shims 104 provide contact between the petals and the projectile.

Figure 6:
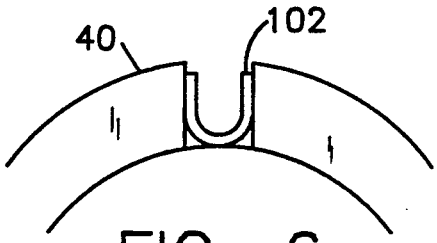
FIG. 6 is a sectional view of another portion of the invention.

If the petals 40 are manufactured with great precision, then there would be no large spaces between abutting petals and no additional shims would be required. However, if an overly wide space is present between petals as illustrated in FIG. 6, then a shim 102 is inserted between adjacent petals in place of the shims 100 in cavities 90,92 and 94.

In operation of the invention wherein the petals 40 are assembled with a projectile 20 and shims 100 and 104, and shims 102 if necesssary, when the projectile is fired, the shims heat up and expand to exert pressure on adjacent petals and force them to fly apart and free the projectile. The traditional air scoop at the front end of the sabot assembly is no longer needed and its elimination permits the cutouts 80 to provide the resultant additional parasitic weight reduction.

One advantage of the present invention, as noted, is that lighter sabots can be used than were usable in the past. In addition, more reliable disengagement of the petals from the projectile can be achieved with minimal disturbance to the flight path of the penetrator. Aim accuracy initially established by the gunner is thereby maintained.

What is claimed is:

1. A projectile-sabot assembly comprising a projectile rod and a plurality of sabot pieces coupled to said projectile rod, wherein said sabot pieces surround said projectile rod, and a cavity in each of said sabot pieces and extending through each of said sabot pieces, the cavity in one sabot piece being aligned with the cavity in the adjacent sabot piece, and at least one heat sensitive shape memory alloy metal shim secured between at least two of said sabot pieces within said aligned cavities which are adjacent to each other, said at least one shim heating during gun launch and exerting pressure pushing said sabot pieces apart when the projectile leaves the gun barrel, and an auxiliary heat sensitive shape memory alloy metal shim disposed between a sabot piece and said projectile rod.

2. The assembly defined in claim 1 wherein each sabot piece has an inner surface which is in contact with said projectile rod when said rod and said sabot pieces are assembled, and a depression in said inner surface, said auxiliary shim being seated in said depression.

3. A projectile-sabot assembly comprising a projectile rod and a plurality of sabot pieces coupled to said projectile rod, wherein each sabot piece includes a rear end, a center portion and a front end, a plurality of heat sensitive shape memory alloy metal shims secured between at least two of said sabot pieces which are adjacent to each other, said shims heating during gun launch and exerting pressure pushing said sabot pieces apart when the projectile leaves the gun barrel, and wherein there are included a plurality of through-cavities in each of said pieces, selected ones of said through-cavities being aligned with each other wherein each through-cavity contains a heat sensitive shape memory alloy metal shim, and wherein one through-cavity is near said rear end, one through-cavity is in said center portion and one through-cavity is near said front end.

4. The assembly defined in claim 3 wherein the front end and rear of each sabot piece is dimensioned to contact the gun barrel when the projectile is fired.

* * * * *